US011348543B2

(12) United States Patent
Wu et al.

(10) Patent No.: US 11,348,543 B2
(45) **Date of Patent: *May 31, 2022**

(54) SCAN-TYPE DISPLAY APPARATUS, AND DRIVING DEVICE AND DRIVING METHOD THEREOF

(71) Applicant: MACROBLOCK, INC., Hsinchu (TW)

(72) Inventors: Yi-Ta Wu, Hsinchu (TW); Chun-Yi Li, Hsinchu (TW); Hung-I Cheng, Hsinchu (TW); Ping-Kai Huang, Hsinchu (TW)

(73) Assignee: MACROBLOCK, INC., Hsinchu (TW)

( * ) Notice: Subject to any disclaimer, the term of this patent is extended or adjusted under 35 U.S.C. 154(b) by 0 days.

This patent is subject to a terminal disclaimer.

(21) Appl. No.: 17/211,437

(22) Filed: Mar. 24, 2021

(65) Prior Publication Data

US 2021/0304691 A1 Sep. 30, 2021

(30) Foreign Application Priority Data

Mar. 26, 2020 (TW) ..... 109110131
Feb. 9, 2021 (TW) ..... 110104899

(51) Int. Cl.
*G09G 3/34* (2006.01)
*G09G 3/36* (2006.01)

(52) U.S. Cl.
CPC ..... *G09G 3/3426* (2013.01); *G09G 3/3648* (2013.01); *G09G 2310/0213* (2013.01);
(Continued)

(58) Field of Classification Search
None
See application file for complete search history.

(56) References Cited

U.S. PATENT DOCUMENTS 6,057,820 A 5/2000 Irwin
8,120,599 B2 2/2012 Kang et al.
(Continued)

FOREIGN PATENT DOCUMENTS

CN 1573880 A 2/2005
CN 1797118 A 7/2006
(Continued)

OTHER PUBLICATIONS

Search Report appended to an Office Action, which was issued to Taiwanese counterpart application No. 109110131 by the TIPO dated Oct. 30, 2020 with an English translation thereof.
(Continued)

*Primary Examiner* — Matthew Yeung
(74) *Attorney, Agent, or Firm* — Akerman LLP; Peter A. Chiabotti

(57) ABSTRACT

A scan-type display apparatus includes an LED array, a display module, a control module and a driver module. The LED array has a common cathode configuration. The control module generates a synchronization control (SC) signal. Based on the SC signal, the driver module outputs an input voltage to scan lines of the LED array sequentially without overlapping in time so as to drive LEDs of the LED array to emit light in a line scan manner, and generates an image refresh signal that is related to the output of the input voltage to one of the scan lines which corresponds to a last line of the line scan in each line scan cycle and that is further related to refreshing of images on a display constituted by the LED array and the display module.

12 Claims, 4 Drawing Sheets

(52) U.S. Cl.
CPC . *G09G 2310/0245* (2013.01); *G09G 2310/08* (2013.01); *G09G 2320/10* (2013.01)

(56) References Cited

U.S. PATENT DOCUMENTS

| | | | | |
|---|---|---|---|---|
| 10,395,586 | B2 | 8/2019 | Kim | |
| 2001/0022572 | A1 | 9/2001 | Murade | |
| 2003/0122773 | A1 | 7/2003 | Washio et al. | |
| 2003/0179221 | A1 | 9/2003 | Nitta et al. | |
| 2004/0207315 | A1* | 10/2004 | Robbie | H01L 27/3293 313/504 |
| 2005/0231449 | A1 | 10/2005 | Miyagawa | |
| 2009/0309855 | A1 | 12/2009 | Wang et al. | |
| 2010/0110097 | A1* | 5/2010 | Nam | G09G 3/3648 345/589 |
| 2011/0141004 | A1 | 6/2011 | Kwon et al. | |
| 2012/0188272 | A1 | 7/2012 | Wang et al. | |
| 2013/0114016 | A1 | 5/2013 | Lim et al. | |
| 2016/0012787 | A1 | 1/2016 | Takahashi et al. | |
| 2016/0063933 | A1 | 3/2016 | Kobayashi et al. | |
| 2016/0125800 | A1 | 5/2016 | Kim | |
| 2017/0038875 | A1 | 2/2017 | Lee | |
| 2018/0018924 | A1* | 1/2018 | Mao | G09G 3/3406 |
| 2018/0090080 | A1 | 3/2018 | Chen et al. | |
| 2018/0293927 | A1 | 10/2018 | Tang et al. | |
| 2019/0206329 | A1 | 7/2019 | Lee et al. | |
| 2019/0251914 | A1 | 8/2019 | Chen | |
| 2019/0362683 | A1 | 11/2019 | Ikeda et al. | |
| 2020/0090597 | A1 | 3/2020 | Chen et al. | |
| 2020/0090608 | A1 | 3/2020 | Calayir et al. | |
| 2021/0304668 | A1 | 9/2021 | Wu et al. | |
| 2021/0304690 | A1 | 9/2021 | Wu et al. | |

FOREIGN PATENT DOCUMENTS

| | | | |
|---|---|---|---|
| CN | 101154353 | A | 4/2008 |
| CN | 102148625 | A | 8/2011 |
| CN | 101436393 | B | 4/2012 |
| CN | 101202017 | B | 5/2012 |
| CN | 106652894 | B | 11/2018 |
| CN | 109192149 | A | 1/2019 |
| CN | 109523958 | A | 3/2019 |
| CN | 209070956 | U | 7/2019 |
| CN | 108550351 | B | 3/2020 |
| TW | 200846775 | A | 12/2008 |
| TW | I390490 | B | 3/2013 |
| TW | I393104 | B | 4/2013 |
| TW | I645392 | B | 12/2018 |
| TW | 201914360 | A | 4/2019 |
| TW | 201935454 | A | 9/2019 |
| TW | I672686 | B | 9/2019 |
| TW | I688945 | B | 3/2020 |

OTHER PUBLICATIONS

Search Report appended to an Office Action and English translation thereof, which was issued in corresponding Taiwanese application No. 109144111 by the TIPO dated Sep. 17, 2021 with an English translation thereof.

Search Report appended to an Office Action and English translation thereof, which was issued in corresponding Taiwanese application No. 110104896 by the TIPO dated Sep. 27, 2021 with an English translation thereof.

Search Report appended to an Office Action and English translation thereof, which was issued in corresponding Taiwanese application No. 110104898 by the TIPO dated Nov. 24, 2021 with an English translation thereof.

Search Report appended to an Office Action and English translation thereof, which was issued to Taiwanese counterpart application No. 110104899 by the TIPO dated Sep. 27, 2021 with an English translation thereof.

Search Report appended to an Office Action and English translation thereof, which was issued in corresponding Taiwanese application No. 110104901 by the TIPO dated Sep. 28, 2021 with an English translation thereof.

Office Action issued in corresponding U.S. Appl. No. 17/205,897 dated Dec. 20, 2021.

Office Action issued in corresponding U.S. Appl. No. 17/211,396 dated Nov. 12, 2021.

Office Action issued in corresponding U.S. Appl. No. 17/211,419 dated Sep. 3, 2021.

Office Action issued in corresponding U.S. Appl. No. 17/211,467 dated Aug. 5, 2021.

Office Action issued in corresponding U.S. Appl. No. 17/211,474 dated Aug. 6, 2021.

Office Action issued in corresponding U.S. Appl. No. 17/211,419 dated Mar. 17, 2022.

Office Action issued in corresponding U.S. Appl. No. 17/211,450 dated Jan. 27, 2022.

* cited by examiner

SCAN-TYPE DISPLAY APPARATUS, AND DRIVING DEVICE AND DRIVING METHOD THEREOF

CROSS-REFERENCE TO RELATED APPLICATION

This application claims priority of Taiwanese Patent Application Nos. 109110131 and 110104899, respectively filed on Mar. 26, 2020 and Feb. 9, 2021.

FIELD

The disclosure relates to displaying techniques, and more particularly to a scan-type display apparatus and to a driving device and a driving method thereof.

BACKGROUND

In a conventional scan-type display apparatus, a driving device for driving a display to show images includes a control module and a driver module. The driver module receives a synchronization control signal and an image stream from the control module. The image stream contains multiple pieces of image data that respectively correspond to multiple images or image frames to be shown by the display. The driver module drives the display based on the synchronization control signal and the image stream such that switching of a backlight module, which includes a light emitting diode (LED) array, of the display between a state where all LEDs are lit and a state where no LEDs are lit is related to the synchronization control signal, such that light emitted by the backlight module is modulated by a display module of the display to show the images or image frames represented by the image stream, and such that refreshing of images on the display is synchronous to the synchronization control signal. The synchronization control signal is a vertical synchronization signal, is periodic, and has a frequency of, for example, 60 Hz. Therefore, the display refreshes periodically, and a frame rate thereof is equal to the frequency of the synchronization control signal.

However, under a circumstance where the synchronization control signal is non-periodic and where the backlight module is a scanning backlight module that is triggered by the synchronization control signal and that emits light in a line scan manner, driving the display module in the aforesaid manner will result in image tearing or image interruption.

SUMMARY

Therefore, an object of the disclosure is to provide a scan-type display apparatus, and a driving device and a driving method thereof. The scan-type display apparatus can alleviate the drawback of the prior art.

According to an aspect of the disclosure, the scan-type display apparatus includes a light emitting diode (LED) array, a display module and a driving device. The LED array serves as a backlight module, has a common cathode configuration, and includes a plurality of scan lines, a plurality of data lines, and a plurality of LEDs arranged in a matrix with a plurality of rows and a plurality of columns. With respect to each of the rows, cathodes of the LEDs in the row are coupled to a respective one of the scan lines. With respect to each of the columns, anodes of the LEDs in the column are coupled to a respective one of the data lines. The display module cooperates with the LED array to constitute a display. The driving device includes a control module and a driver module. The control module generates a synchronization control signal. The driver module is coupled to the scan lines and the control module, is to receive an input voltage, and is to further receive the synchronization control signal from the control module. Based on the synchronization control signal, the driver module outputs the input voltage to the scan lines sequentially without overlapping in time so as to drive the LEDs to emit light in a line scan manner, and generates an image refresh signal that is related to the output of the input voltage to one of the scan lines which corresponds to a last line of the line scan in each line scan cycle and that is further related to refreshing of images on the display.

According to another aspect of the disclosure, the driving device is adapted to be used in a scan-type display apparatus. The scan-type display apparatus includes a light emitting diode (LED) array and a display module that cooperatively constitute a display. The LED array has a common cathode configuration, and includes a plurality of scan lines. The driving device includes a control module and a driver module. The control module generates a synchronization control signal. The driver module is adapted to be coupled to the scan lines, is further coupled to the control module to receive the synchronization control signal therefrom, and is to further receive an input voltage. Based on the synchronization control signal, the driver module outputs the input voltage to the scan lines sequentially without overlapping in time so as to drive the LED array to emit light in a line scan manner, and generates an image refresh signal that is related to the output of the input voltage to one of the scan lines which corresponds to a last line of the line scan in each line scan cycle and that is further related to refreshing of images on the display.

According to yet another aspect of the disclosure, the driving method is to be implemented by a driver module, and is adapted to drive a display. The display includes a light emitting diode (LED) array that has a common cathode configuration and that includes a plurality of scan lines. The driving method includes steps of: receiving a synchronization control signal from a control module; and based on the synchronization control signal, outputting an input voltage to the scan lines sequentially without overlapping in time so as to drive the LED array to emit light in a line scan manner, and generating an image refresh signal that is related to the output of the input voltage to one of the scan lines which corresponds to a last line of the line scan in each line scan cycle and that is further related to refreshing of images on the display.

According to still another aspect of the disclosure, the scan-type display apparatus includes a light emitting diode (LED) array and a driving device. The LED array serves as a display, has a common cathode configuration, and includes a plurality of scan lines, a plurality of data lines, and a plurality of LEDs arranged in a matrix with a plurality of rows and a plurality of columns. With respect to each of the rows, cathodes of the LEDs in the row are coupled to a respective one of the scan lines. With respect to each of the columns, anodes of the LEDs in the column are coupled to a respective one of the data lines. The driving device includes a control module and a driver module. The control module generates an image stream and a synchronization control signal. The driver module is coupled to the scan lines, the data lines and the control module, is to receive an input voltage, and is to further receive the image stream and the synchronization control signal from the control module. Based on the synchronization control signal, the driver module outputs the input voltage to the scan lines sequentially without overlapping in time so as to drive the LEDs to emit light in a line scan manner, and generates an image refresh signal that is related to the output of the input voltage to one of the scan lines which corresponds to a last line of the line scan in each line scan cycle. The driver module generates a plurality of driving signals based on the image stream and the image refresh signal, and outputs the driving signals respectively to the data lines.

BRIEF DESCRIPTION OF THE DRAWINGS

Other features and advantages of the disclosure will become apparent in the following detailed description of the embodiments with reference to the accompanying drawings, of which.

DETAILED DESCRIPTION

Figure 1:
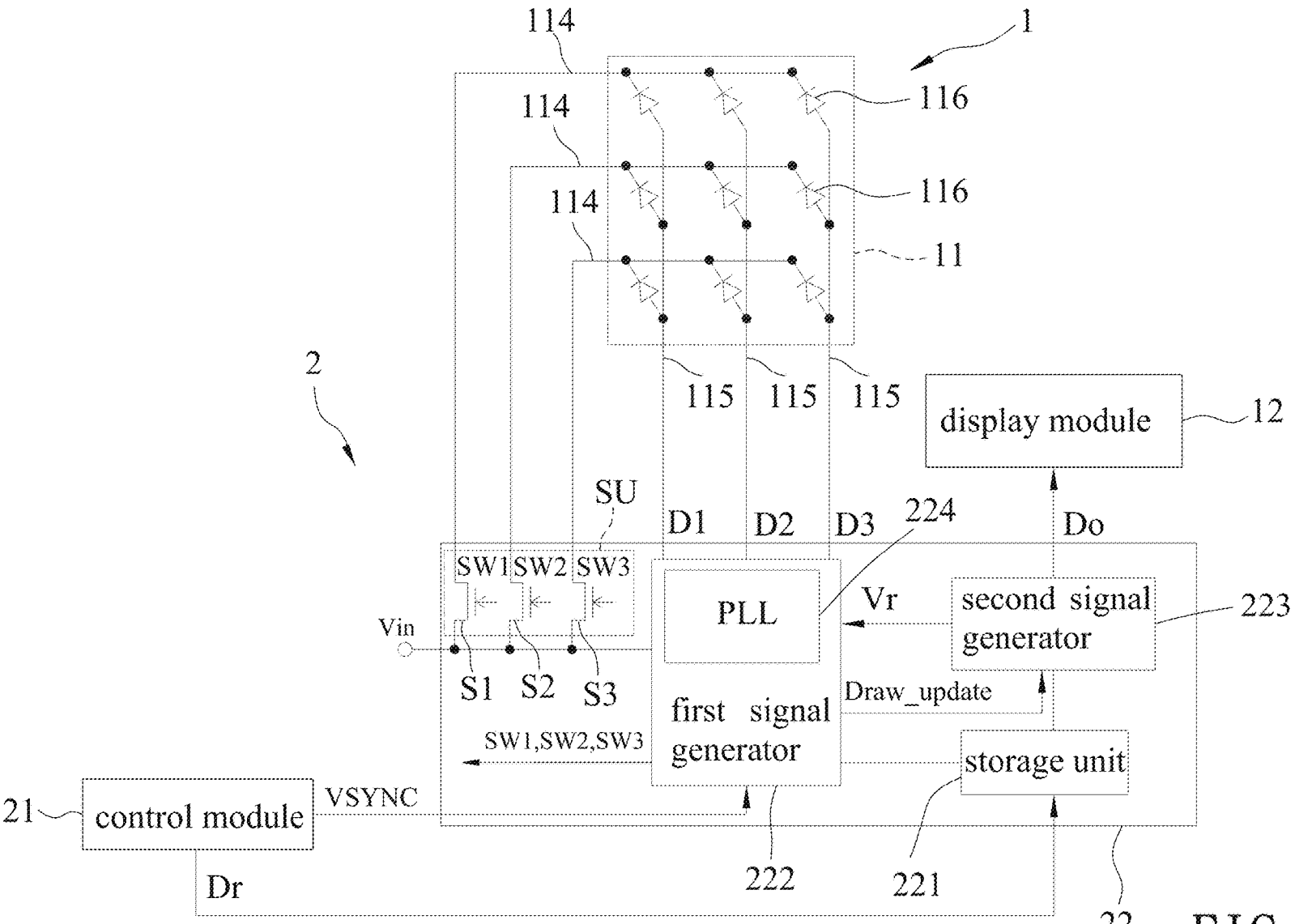
FIG. 1 is a circuit block diagram illustrating a first embodiment of a scan-type display apparatus according to the disclosure.

Before the disclosure is described in greater detail, it should be noted that where considered appropriate, reference numerals or terminal portions of reference numerals have been repeated among the figures to indicate corresponding or analogous elements, which may optionally have similar characteristics.

Figure 2:
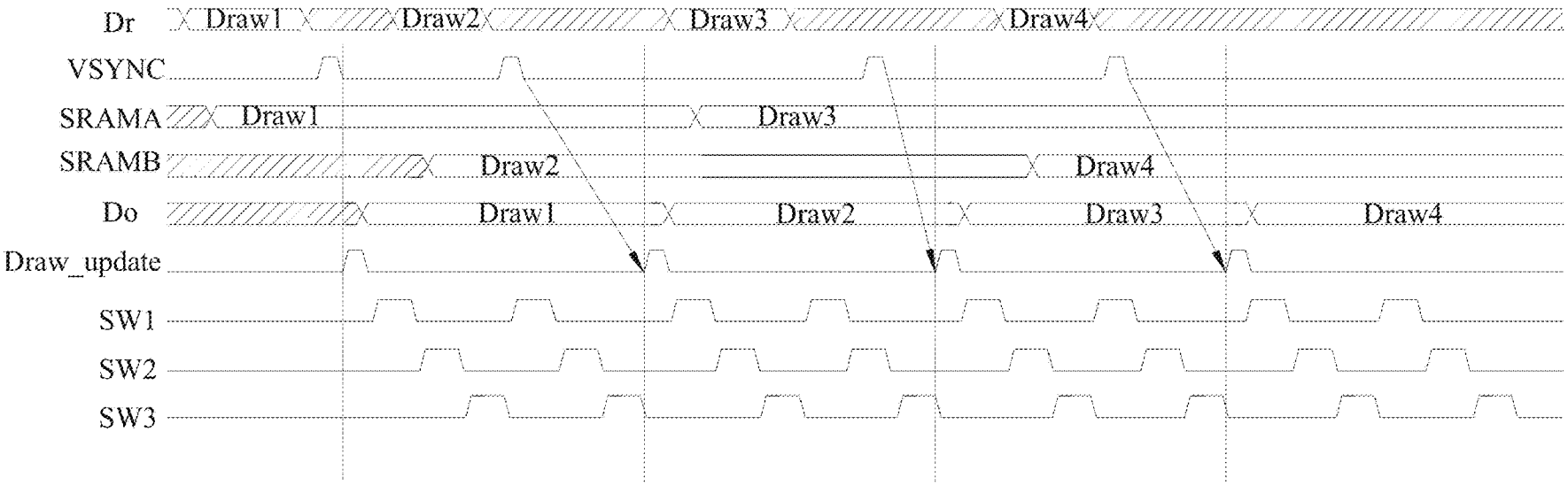
FIG. 2 is a timing diagram illustrating operations of the first embodiment.

Referring to FIGS. 1 and 2, a first embodiment of a scan-type display apparatus according to the disclosure is, for example, a liquid crystal display apparatus, supports dynamic frame rate technologies, and includes a light emitting diode (LED) array 11, a display module 12 and a driving device 2. The LED array 11 serves as a backlight module. The display module 12 is, for example, a liquid crystal panel, and cooperates with the LED array 11 to constitute a display 1 that is able to show images.

The LED array 11 has a common cathode configuration, and includes a plurality of scan lines 114, a plurality of data lines 115, and a plurality of LEDs 116 arranged in a matrix with a plurality of rows and a plurality of columns. With respect to each of the rows, cathodes of the LEDs 116 in the row are coupled to a respective one of the scan lines 114. With respect to each of the columns, anodes of the LEDs 116 in the column are coupled to a respective one of the data lines 115. For illustration purposes, the LED array 11 includes three scan lines 114, three data lines 115 and nine LEDs 116.

The driving device 2 includes a control module 21 and a driver module 22.

The control module 21 generates a synchronization control signal (VSYNC), and includes a graphic processing unit (GPU) (not shown) that generates an image stream (Dr). The image stream (Dr) contains multiple pieces of image data that respectively correspond to multiple images or image frames to be shown by the display 1. For illustration purposes, the image stream (Dr) exemplarily contains four pieces of image data (Draw1-Draw4). In this embodiment, the control module 21 sequentially outputs the pieces of image data (Draw1-Draw4) to serve as the image stream (Dr).

The driver module 22 is coupled to the LED array 11, the display module 12 and the control module 21, is to receive the synchronization control signal (VSYNC) and the image stream (Dr) from the control module 21, and drives the LED array 11 and the display module 12 based on the synchronization control signal (VSYNC) and the image stream (Dr).

In this embodiment, the driver module 22 includes a switch unit (SU), a storage unit 221, a first signal generator 222 and a second signal generator 223. The switch unit (SU) includes a plurality of switches (e.g., three switches (S1-S3)). Each of the switches (S1-S3) (e.g., an N-type metal oxide semiconductor field effect transistor (nMOSFET)) has a first terminal (e.g., a source terminal) that is to receive an input voltage (Vin) (e.g., aground voltage), a second terminal (e.g., a drain terminal) that is coupled to a respective one of the scan lines 114, and a control terminal (e.g., a gate terminal). Each of the switches (S1-S3), when conducting, permits transmission of the input voltage (Vin) therethrough to the respective one of the scan lines 114. The storage unit 221 is coupled to the control module 21. The first signal generator 222 is coupled to the data lines 115, the control module 21, the control terminals of the switches (S1-S3) and the storage unit 221, and includes a phase-locked loop (PLL) 224. The second signal generator 223 is coupled to the display module 12, the storage unit 221 and the first signal generator 222. It should be noted that the second signal generator 223 includes a source driver and a gate driver, and is well known in the art, and therefore details thereof are omitted herein for the sake of brevity. It should also be noted that the switch unit (SU) and the first and second signal generators 222, 223 are fabricated on a single chip.

Figure 3:
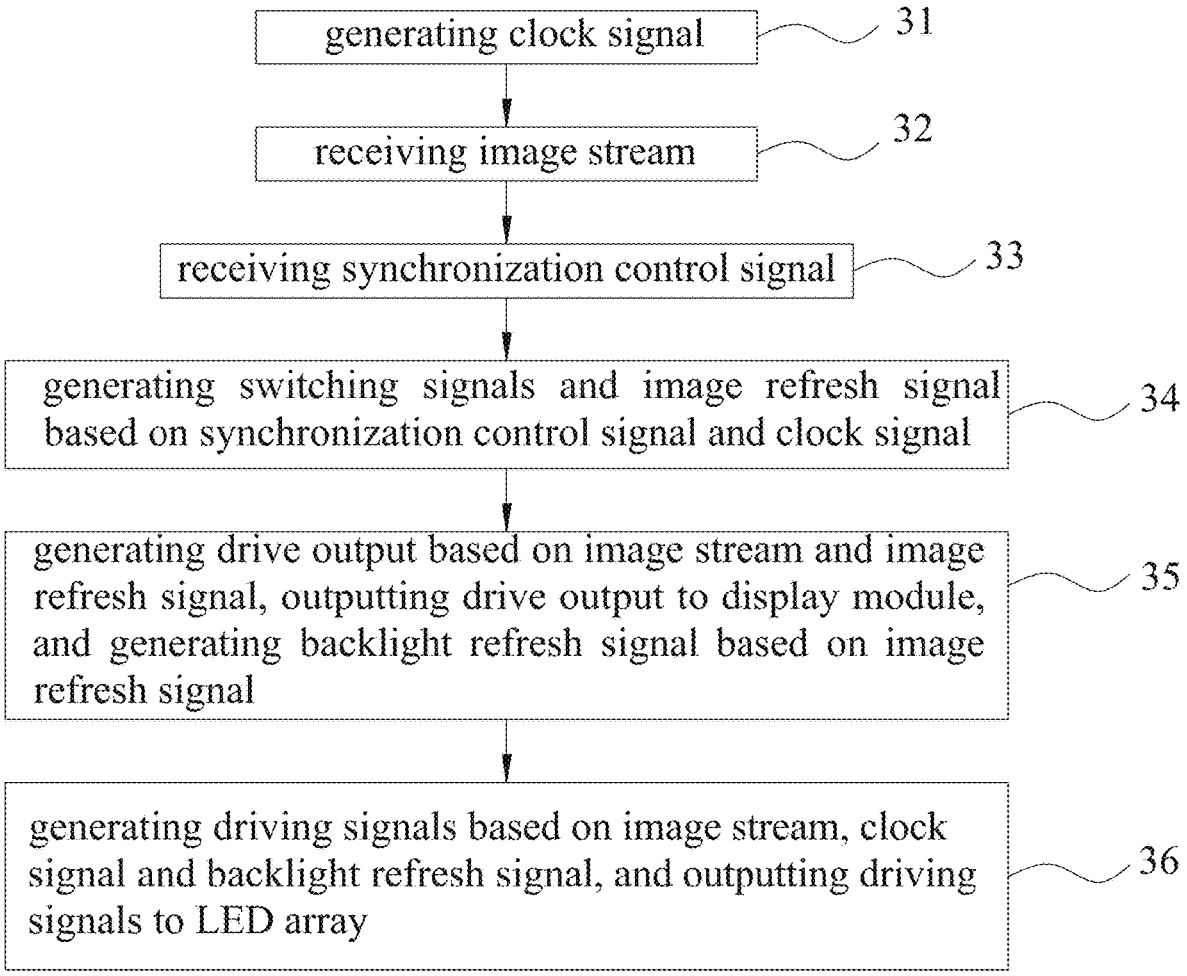
FIG. 3 is a flowchart illustrating a driving method performed by the first embodiment.

Referring to FIGS. 1 to 3, in this embodiment, a driving method performed by the driver module 22 to drive the display 1 to show images includes the following steps.

In step 31, the driver module 22 generates a clock signal. To be specific, the PLL 224 generates the clock signal.

In step 32, the driver module 22 receives the image stream (Dr) from the control module 21. To be specific, the storage unit 221 receives the image stream (Dr) from the control module 21, and stores the image stream (Dr). In this embodiment, the storage unit 221 includes two memories (SRAMA, SRAMB) that alternately store the pieces of image data (Draw1-Draw4) and that alternately output the pieces of image data (Draw1-Draw4) stored therein.

In step 33, the driver module 22 receives the synchronization control signal (VSYNC) from the control module 21. To be specific, the first signal generator 222 receives the synchronization control signal (VSYNC) from the control module 21.

In step 34, based on the synchronization control signal (VSYNC) and the clock signal, the driver module 22 performs the following: outputting the input voltage (Vin) to the scan lines 114 sequentially without overlapping in time, so as to drive the LEDs 116 to emit light in a line scan manner; and generating an image refresh signal (Draw update) that is related to the output of the input voltage (Vin) to one of the scan lines 114 which corresponds to a last line of the line scan in each line scan cycle, and that is further related to refreshing of images on the display 1 (i.e., an act of the display 1 switching from displaying a current image or image frame to displaying a next image or image frame). To be specific, based on the synchronization control signal (VSYNC) and the clock signal, the first signal generator 222 generates a plurality of switching signals (e.g., three switching signals (SW1-SW3)) for receipt by the control terminals of the switches (S1-S3), and generates the image refresh signal (Draw update) that is further related to one of the switching signals (SW1-SW3) which corresponds to the last line of the line scan in each line scan cycle (i.e., the switching signal (SW3)).

In this embodiment, each of the synchronization control signal (VSYNC), the image refresh signal (Draw update) and the switching signals (SW1-SW3) is a pulse signal. Each of the switching signals (SW1-SW3) has a pulse width that is a multiple of a period of the clock signal. In each line scan cycle of the LEDs 116, the pulses of the switching signals (SW1-SW3) are staggered and non-overlapping in time (i.e., the pulse of the switching signal (SW1), the pulse of the switching signal (SW2) and the pulse of the switching signal (SW3) occur one by one without overlapping one another in time). Transition of the switching signals (SW1-SW3) is triggered by the first pulse of the image refresh signal (Draw update). Each of the switches (S1-S3) conducts within each pulse of one of the switching signals (SW1-SW3) that is received thereby, and does not conduct outside the pulses of said one of the switching signals (SW1-SW3). Therefore, the switches (S1-S3) conduct one by one without overlapping in time, the input voltage (Vin) is outputted by the switch unit (SU) to the scan lines 114 sequentially without overlapping in time, and the LEDs 116 can emit light row by row without overlapping in time (i.e., the LEDs 116 can emit light in the line scan manner). Each pulse of the image refresh signal (Draw update) lags a respective pulse of the synchronization control signal (VSYNC). A starting point of the first pulse of the image refresh signal (Draw update) is substantially concurrent with an endpoint of the first pulse of the synchronization control signal (VSYNC). A starting point of each pulse of the image refresh signal (Draw update), except the first pulse, is substantially concurrent with an end point of a pulse of said one of the switching signals (SW1-SW3) (i.e., the switching signal (SW3)) that occurs immediately after an end point of the respective pulse of the synchronization control signal (VSYNC).

It should be noted that each row of the LEDs 116 corresponds to a respective line of the line scan of the LEDs 116 (namely, a respective line of the LEDs 116 that emits light in each line scan cycle).

In step 35, The driver module 22 generates a drive output (Do) based on the image stream (Dr) and the image refresh signal (Draw update) and outputs the drive output (Do) to the display module 12, such that the display 1 shows images or image frames represented by the image stream (Dr) and that the refreshing of images on the display 1 is synchronous to the line scan. In addition, the driver module 22 generates, based on the image refresh signal (Draw update), a backlight refresh signal (Vr) that indicates when the drive output (Do) changes. To be specific, the second signal generator 223 receives the image stream (Dr) stored in the storage unit 221, further receives the image refresh signal (Draw update) from the first signal generator 222, generates the drive output (Do) based on the image stream (Dr) and the image refresh signal (Draw update), outputs the drive output (Do) to the display module 12, and generates the backlight refresh signal (Vr) based on the image refresh signal (Draw update).

In step 36, the driver module 22 generates a plurality of driving signals (e.g., three driving signals (D1-D3)) based on the image stream (Dr), the clock signal and the backlight refresh signal (Vr) and outputs the driving signals (D1-D3) respectively to the data lines 115, such that refreshing of backlight provided by the LEDs 116 is synchronous to the refreshing of images on the display 1. To be specific, the first signal generator 222 receives the image stream (Dr) stored in the storage unit 221, receives the backlight refresh signal (Vr) from the second signal generator 223, generates the driving signals (D1-D3) based on the image stream (Dr), the clock signal and the backlight refresh signal (Vr), and outputs the driving signals (D1-D3) respectively to the data lines 115. In this embodiment, each of the driving signals (D1-D3) is a pulse signal, and has a pulse width that is a multiple of the period of the clock signal, and the multiple varies according to the image stream (Dr).

In this embodiment, for each of the LEDs 116, within any one of the pulses of the driving signal (D1/D2/D3) that is outputted to the data line 115 coupled to the LED 116, the LED 116 emits light when the switch (S1/S2/S3) that is coupled to the LED 116 conducts. In addition, light transmittance of the display module 12 varies according to the image stream (Dr), and light emitted by the LEDs 116 is modulated by the display module 12 to produce the images or image frames represented by the image stream (Dr).

It should be noted that, in this embodiment, step 31 is executed before execution of step 32. However, in other embodiments, step 31 may be executed after execution of step 32 and before execution of step 33, or may be executed after execution of step 33 and before execution of step 34.

In view of the above, the scan-type display apparatus of this embodiment has the following advantages.

1. In the LED array 11, with respect to each of the columns, when the LEDs 116 in the column are red LEDs, the driving signal (D1/D2/D3) that is outputted to the data line 115 coupled to the LEDs 116 in the column can be sourced from a supply voltage with a relatively low magnitude, so as to reduce power consumption of the scan-type display apparatus.

2. Since the switching signals (SW1-SW3) are generated by the driver module 22, and not the control module 21, the control module 21 has low complexity in terms of hardware design and software setting.

3. Since the switch unit (SU) and the first and second signal generators 222, 223 are fabricated on a single chip, a total number of electronic components on a printed circuit board (PCB) that carries the scan-type display apparatus and space occupied by the electronic components on the PCB can be effectively reduced, and layout of the PCB would be relatively simple, so printing error rate of the PCB can be reduced to improve overall yield rate, and evaluation time during the design stage can be reduced to speed up commercialization of the scan-type display apparatus. In addition, the scan-type display apparatus can be implemented as a small-sized consumer electronic display apparatus that has a high resolution and a high LED arrangement density. Moreover, there is no issue as to matching the switches (S1-S3) of the switch unit (SU) to a power supply, so design efficiency can be enhanced.

4. By virtue of the second signal generator 223 generating the drive output (Do) based on the image refresh signal (Draw update), the refreshing of images on the display 1 can occur when the line scan cycle of the LEDs 116 ends, thereby preventing image tearing or image interruption and attaining better display quality.

Figure 4:
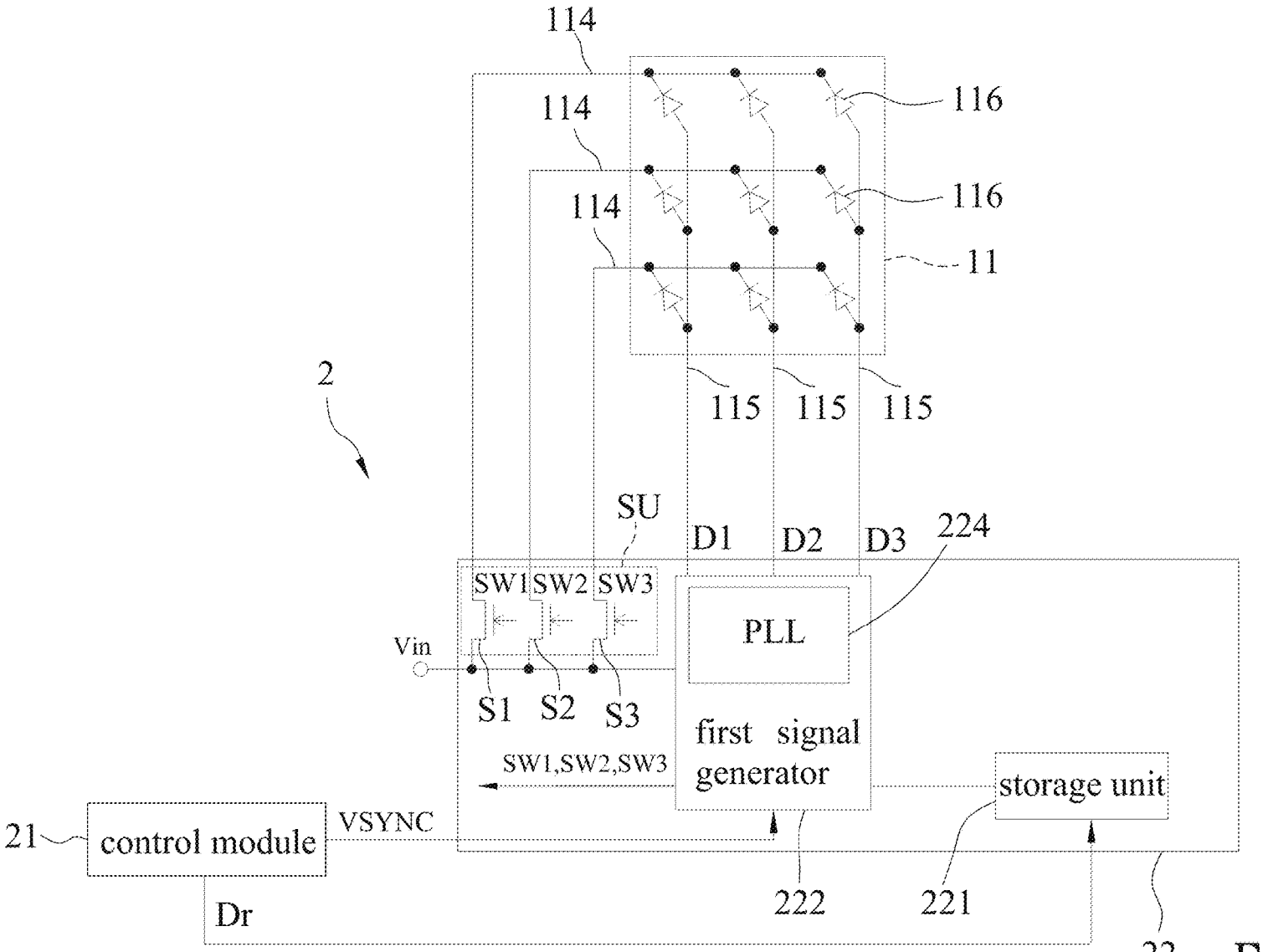
FIG. 4 is a circuit block diagram illustrating a second embodiment of the scan-type display apparatus according to the disclosure.

Referring to FIG. 4, a second embodiment of the scan-type display apparatus according to the disclosure is similar to the first embodiment, but differs from the first embodiment in that: (a) the display module 12 (see FIG. 1) and the second signal generator 223 (see FIG. 1) are omitted; (b) the LED array 11 serves as a display that is able to show images; (c) the first signal generator 222 generates the driving signals (D1-D3) based on the image stream (Dr), the clock signal and the image refresh signal (Draw update); and (d) the LED array 11 produces the images or image frames represented by the image stream (Dr), and refreshing of images on the LED array 11 occurs when the line scan cycle of the LED array 11 ends.

In the description above, for the purposes of explanation, numerous specific details have been set forth in order to provide a thorough understanding of the embodiments. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the disclosure has been described in connection with what are considered the exemplary embodiments, it is understood that the disclosure is not limited to the disclosed embodiments but is intended to cover various arrangements included within the spirit and scope of the broadest interpretation so as to encompass all such modifications and equivalent arrangements.

What is claimed is:

1. A scan-type display apparatus comprising:

a light emitting diode (LED) array serving as a backlight module, having a common cathode configuration, and including a plurality of scan lines, a plurality of data lines, and a plurality of LEDs arranged in a matrix with a plurality of rows and a plurality of columns; with respect to each of said rows, cathodes of said LEDs in said row being coupled to a respective one of said scan lines; with respect to each of said columns, anodes of said LEDs in said column being coupled to a respective one of said data lines;

a display module cooperating with said LED array to constitute a display; and a driving device including a control module and a driver module;

said control module generating a synchronization control signal);

said driver module being coupled to said scan lines and said control module, being to receive an input voltage, and being to further receive the synchronization control signal from said control module;

based on the synchronization control signal, said driver module outputting the input voltage to said scan lines sequentially without overlapping in time, so as to drive said LEDs to emit light in a line scan manner, and generating an image refresh signal that is related to the output of the input voltage to one of said scan lines which corresponds to a last line of the line scan in each line scan cycle, and that is further related to refreshing of images on said display.

2. The scan-type display apparatus of claim 1, wherein:

said control module further generates an image stream;

said driver module is further coupled to said display module, and is to further receive the image stream from said control module; and said driver module further generates a drive output based on the image stream and the image refresh signal and outputs the drive output to said display module, such that said display shows images represented by the image stream and that the refreshing of images on said display is synchronous to the line scan.

3. The scan-type display apparatus of claim 1, wherein said control module further generates an image stream, and said driver module includes:

a switch unit coupled to said scan lines, to receive the input voltage and a plurality of switching signals, and switching based on the switching signals to output the input voltage to said scan lines sequentially without overlapping in time;

a first signal generator coupled to said control module and said switch unit, to receive the synchronization control signal from said control module, and including a phase-locked loop that generates a clock signal;

based on the synchronization control signal and the clock signal, said first signal generator generating the switching signals for receipt by said switch unit, and generating the image refresh signal that is further related to one of the switching signals which corresponds to the last line of the line scan in each line scan cycle; and a second signal generator coupled to said display module and said first signal generator, to receive the image refresh signal from said first signal generator, and disposed to further receive the image stream;

said second signal generator generating a drive output based on the image stream and the image refresh signal, and outputting the drive output to said display module.

4. The scan-type display apparatus of claim 3, wherein:

said switch unit includes a plurality of switches;

each of said switches has a first terminal that is to receive the input voltage, a second terminal that is coupled to a respective one of said scan lines, and a control terminal that is coupled to said first signal generator to receive a respective one of the switching signals therefrom;

each of said switches, when conducting, permits transmission of the input voltage therethrough to the respective one of said scan lines; and said switch unit and said first and second signal generators are fabricated on a single chip.

5. The scan-type display apparatus of claim 3, wherein:

said second signal generator further generates a backlight refresh signal based on the image refresh signal;

said first signal generator is further coupled to said data lines, is to further receive the backlight refresh signal from said second signal generator, and is disposed to further receive the image stream; and said first signal generator generates a plurality of driving signals based on the image stream and the backlight refresh signal, and outputs the driving signals respectively to said data lines.

6. The scan-type display apparatus of claim 5, wherein said driver module further includes:

a storage unit coupled to said control module to receive the image stream therefrom, and storing the image stream;

each of said first and second signal generators being further coupled to said storage unit to receive the image stream stored therein.

7. A driving device adapted to be used in a scan-type display apparatus, the scan-type display apparatus including a light emitting diode (LED) array and a display module that cooperatively constitute a display, the LED array having a common cathode configuration, and including a plurality of scan lines, said driving device comprising:

a control module generating a synchronization control signal; and a driver module adapted to be coupled to the scan lines, further coupled to said control module to receive the synchronization control signal therefrom, and to further receive an input voltage;

based on the synchronization control signal, said driver module outputting the input voltage to the scan lines sequentially without overlapping in time, so as to drive the LED array to emit light in a line scan manner, and generating an image refresh signal that is related to the output of the input voltage to one of the scan lines which corresponds to a last line of the line scan in each line scan cycle, and that is further related to refreshing of images on the display.

8. The driving device of claim 7, wherein said control module further generates an image stream, and said driver module includes:

a switch unit adapted to be coupled to the scan lines, to receive the input voltage and a plurality of switching signals, and switching based on the switching signals to output the input voltage to the scan lines sequentially without overlapping in time;

a first signal generator coupled to said control module and said switch unit, to receive the synchronization control signal from said control module, and including a phase-locked loop that generates a clock signal;

based on the synchronization control signal and the clock signal, said first signal generator generating the switching signals for receipt by said switch unit, and generating the image refresh signal that is further related to one of the switching signals which corresponds to the last line of the line scan in each line scan cycle; and a second signal generator adapted to be coupled to the display module, further coupled to said first signal generator to receive the image refresh signal therefrom, and disposed to further receive the image stream;

said second signal generator generating a drive output based on the image stream and the image refresh signal, and outputting the drive output to the display module.

9. A driving method to be implemented by a driver module and adapted to drive a display, the display including a light emitting diode (LED) array that has a common cathode configuration and that includes a plurality of scan lines, said driving method comprising steps of:

receiving a synchronization control signal from a control module; and based on the synchronization control signal, outputting an input voltage to the scan lines sequentially without overlapping in time so as to drive the LED array to emit light in a line scan manner, and generating an image refresh signal that is related to the output of the input voltage to one of the scan lines which corresponds to a last line of the line scan in each line scan cycle and that is further related to refreshing of images on the display.

10. The driving method of claim 9, further comprising steps of:

receiving an image stream from the control module; and generating a drive output based on the image stream and the image refresh signal and outputting the drive output to the display, such that the display shows images represented by the image stream and that the refreshing of images on the display is synchronous to the line scan.

11. A scan-type display apparatus comprising:

a light emitting diode (LED) array serving as a display, having a common cathode configuration, and including a plurality of scan lines, a plurality of data lines, and a plurality of LEDs arranged in a matrix with a plurality of rows and a plurality of columns; with respect to each of said rows, cathodes of said LEDs in said row being coupled to a respective one of said scan lines; with respect to each of said columns, anodes of said LEDs in said column being coupled to a respective one of said data lines; and a driving device including a control module and a driver module;

said control module generating an image stream and a synchronization control signal;

said driver module being coupled to said scan lines, said data lines and said control module, being to receive an input voltage, and being to further receive the image stream and the synchronization control signal from said control module;

based on the synchronization control signal, said driver module outputting the input voltage to said scan lines sequentially without overlapping in time, so as to drive said LEDs to emit light in a line scan manner, and generating an image refresh signal that is related to the output of the input voltage to one of said scan lines which corresponds to a last line of the line scan in each line scan cycle;

said driver module generating a plurality of driving signals based on the image stream and the image refresh signal, and outputting the driving signals respectively to said data lines.

12. The scan-type display apparatus of claim 11, wherein said driver module includes:

a switch unit coupled to said scan lines, to receive the input voltage and a plurality of switching signals, and switching based on the switching signals to output the input voltage to said scan lines sequentially without overlapping in time;

a storage unit coupled to said control module to receive the image stream therefrom, and storing the image stream; and a signal generator coupled to said data lines, said control module, said switch unit and said storage unit, to receive the synchronization control signal from said control module, to further receive the image stream stored in said storage unit, and including a phase-locked loop that generates a clock signal;

based on the synchronization control signal and the clock signal, said signal generator generating the switching signals for receipt by said switch unit, and generating the image refresh signal that is further related to one of the switching signals which corresponds to the last line of the line scan in each line scan cycle;

said signal generator generating the driving signals based on the image stream and the image refresh signal, and outputting the driving signals respectively to said data lines.

* * * * *